United States Patent [19]

Tosaka et al.

[11] Patent Number: 5,074,926

[45] Date of Patent: Dec. 24, 1991

[54] HIGH TENSILE COLD ROLLED STEEL SHEET AND HIGH TENSILE HOT DIP GALVANIZED STEEL SHEET HAVING IMPROVED STRETCH FLANGING PROPERTY AND PROCESS FOR PRODUCING SAME

[75] Inventors: Akio Tosaka; Fusao Togashi; Hiroshi Hashimoto, all of Chiba, Japan

[73] Assignee: Kawasaki Steel Corp., Hyogo, Japan

[21] Appl. No.: 612,405

[22] Filed: Nov. 13, 1990

[30] Foreign Application Priority Data

| | | | |
|---|---|---|---|
| Nov. 16, 1989 | [JP] | Japan | 1-296158 |
| Apr. 4, 1990 | [JP] | Japan | 2-88122 |
| Oct. 17, 1990 | [JP] | Japan | 2-276471 |

[51] Int. Cl.[5] ..... C21D 9/46

[52] U.S. Cl. ..... 148/12 D; 148/156; 148/333; 428/659

[58] Field of Search ..... 148/2, 12 D, 156, 12 R, 148/320, 332, 333; 428/681, 659

[56] References Cited

U.S. PATENT DOCUMENTS

| | | | |
|---|---|---|---|
| 4,473,414 | 9/1984 | Irie et al. | 428/659 |
| 4,525,598 | 6/1985 | Tsukamoto et al. | 428/659 |

FOREIGN PATENT DOCUMENTS

| | | |
|---|---|---|
| 0044723 | 4/1981 | Japan . |
| 0057828 | 4/1982 | Japan . |
| 1056245 | 3/1986 | Japan . |

*Primary Examiner*—R. Dean
*Assistant Examiner*—Sikyin Ip
*Attorney, Agent, or Firm*—Bierman and Muserlian

[57] ABSTRACT

A high tensile cold rolled steel sheet improved in stretch flanging property, containing 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities, and the steel sheet having a uniform and fine recrystallized ferrite structure having a mean grain diameter of 20 μm or less and an area fraction of 95% or more having improving ductility and a process for its preparation.

5 Claims, No Drawings

HIGH TENSILE COLD ROLLED STEEL SHEET AND HIGH TENSILE HOT DIP GALVANIZED STEEL SHEET HAVING IMPROVED STRETCH FLANGING PROPERTY AND PROCESS FOR PRODUCING SAME

BACKGROUND OF THE INVENTION

1. Field of the Invention

This invention relates to a cold rolled steel sheet and a hot dip galvanized steel sheet which have a tensile strength (hereinafter abbreviated as T.S.) of more than 40 kgf/mm$^2$ and are improved in ductility, particularly, in stretch flanging property, and processes for producing same.

2. Description of the Related Art

There has been an increasing demand for high tensile cold rolled steel sheets having a T.S. of more than 40 kgf/mm$^2$, e.g., in automobile industry, to enhance the safety and reduce weight for fuel economy, as well as for hot dip galvanized steel sheets using a high tensile cold rolled sheet to improve the rustproof property. Further, there is a demand for construction materials having a smaller thickness to reduce the cost, and also in this field, high tensile cold rolled steel sheets are greatly demanded.

In these applications, high tensile steel sheets are required to have satisfactory workability, such as in pressing.

To meet these requirements, a process for producing high Mn—Si steel as a material has been proposed, e.g., in Japanese Patent Disclosure No. 57-63634 and No. 56-13437. In this process, however, an increased tensile strength is achieved chiefly by solution hardening, and therefore, a large quantity of Si, which serves to increase the strength, must be admixed, thus posing problems in surface properties and effectiveness of phosphatizing and hot dipping.

As a process which does not rely upon the alloy composition, unlike the above process, a process utilizing a annealed recovery structure is proposed, e.g., in Japanese Patent Disclosure No. 60-33318. However, this process has problems, such as fluctuation in properties, low ductility, and large planar anisotropy, and although the cost is low, the process is not efficient enough to permit a mass production.

This invention relates to a high tensile cold rolled steel sheet and a high tensile hot dip galvanized steel sheet which have a T.S. of more than 40 kgf/mm$^2$ and solves the problems associated with the prior art, and an object thereof is to provide a high tensile cold rolled steel sheet and a high tensile hot dip galvanized steel sheet, both satisfying the below-mentioned conditions and having an excellent stretch flanging property, and processes for producing same.

(1) Eliminates the need for the admixture of Si which deteriorates the surface properties and the effectiveness of hot dipping, and provides a low alloy system.

(2) Improves the ductility, in particular, the stretch flanging property (3) Achieves stable properties with less planar anisotropy.

(4) Imposes no restrictions on particularly severe operating conditions.

SUMMARY OF THE INVENTION

To solve the above-described problems, the inventors comprehensively examined steels of various component systems and various producing conditions, focusing their attention on the properties and structures, and found that a remarkably excellent stretch flanging property can be obtained by reducing the percentage of the second phase e.g., pearlite, to obtain a recrystallized ferrite structure consisting of uniformly fine grains, and that such a desirable structure can be obtained mainly by optimizing the combination of steel composition, cold rolling condition, and annealing condition.

This invention is based on the above findings.

This invention provides a high tensile cold rolled steel sheet improved in stretch flanging property, which contains 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities, and the steel sheet having a uniform and fine recrystallized ferrite structure having a mean grain diameter of 20 μm or less and an area fraction of 95% or more.

According to this invention, there is also provided a process for producing a high tensile cold rolled steel sheet improved in stretch flanging property, which comprises the steps of: preparing, as a material, steel containing 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities; subjecting the material to hot rolling; effecting cold rolling at a reduction rate in thickness of more than 50%; and effecting annealing in which the material is heated at a heating rate of 5° C./sec or more and retained in a temperature range of 720° to 780° C. for 20 to 60 seconds in a continuous annealing line, and then cooling the material.

Further, the invention provides a high tensile hot dip galvanized steel sheet improved in stretch flanging property, which contains 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities, and the steel sheet having a uniform and fine recrystallized ferrite structure having a mean grain diameter of 20 μm or less and an area fraction of 95% or more.

Furthermore, a process is provided for producing a high tensile hot dip galvanized steel sheet improved in stretch flanging property, which comprises the steps of: preparing, as a material, steel containing 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities; subjecting the material to hot rolling; effecting cold rolling at a reduction rate in thickness of more than 50%; and effecting annealing in which the material is heated at a heating rate of 5° C./sec or more and retained in a temperature range of 720° to 780° C. for 20 to 60 seconds in an in-line anneal type continuous hot dip galvanizing line, and then cooling and hot-dipping the material.

Moreover, the invention provides a process for producing a high tensile hot dip galvanized steel sheet improved in stretch flanging property, which comprises the steps of: preparing, as a material, steel containing 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities; subjecting the material to hot rolling; effecting cold rolling at a reduction rate in thickness of more than 50%; and effecting annealing in which the material is heated at a heating rate of 5° C./sec or more and retained in a temperature range of 720° to 780° C. for 20 to 60 seconds in an in-line anneal type continuous hot dip galvanizing line, and then cooling, galvanizing and galvannealing the material.

DETAILED DESCRIPTION OF THE INVENTION

First, the reason for defining the aforementioned ranges for the components of the steel according to this invention will be described.

C: 0.03% to 0.15%

C is most effective as a component for increasing the strength and is also a desirable component because it is inexpensive. However, if C is added in excess of 0.15%, the percentage of the second phase, e.g., pearlite, is significantly increased, and the ductility, in particular, the stretch flanging property, is extremely lowered. Moreover, the weldability is significantly lowered. On the other hand, with a C content smaller than 0.03%, a sufficiently high T.S. cannot be attained even if other elements are added. For this reason, C is added in the range of 0.03% to 0.15%.

Si: 0.05% or less

Si is effective for increasing the strength of steel and has a little influence on the deterioration of ductility, and thus is an element which may desirably be contained in a large quantity in consideration of mechanical properties. However, Si is at the same time an element which extremely deteriorates the surface properties due to scales and the effectiveness of hot dipping. Therefore, to obtain a fine appearance in the surface, the Si content must be 0.05% or less.

Mn: 0.5% to 1.2%

Mn is less effective in solution hardening than C, Si, or the like, and yet serves to increase the strength. Further, Mn has the property of restraining the pearlite from being produced excessively and coarsened and thus making the grains fine. To achieve these effects, more than 0.5% of Mn must be admixed. If, however, Mn is added in excess of 1.2%, its property of increasing the strength becomes saturated, and the stretch flanging property is lowered because the second phase becomes likely to distribute in the form of stratum, thus deteriorating the effectiveness of hot dipping. Accordingly, the range for the Mn content is set from 0.5% to 1.2%.

Nb: 0.005% to 0.045%

The addition of Nb and the control of the Nb content constitute one of important factors of this invention. According to this invention, the strength and the ductility, particularly the stretch flanging property, are improved by finally obtaining a very fine and uniform recrystallized ferrite structure due to the effect of Nb. These advantageous effects are supposedly attained because Nb is precipitated as carbo-nitride, but the cause is not known in detail. The advantages can be achieved only by adding more than 0.005% by weight of Nb, and the effects become saturated when Nb is added in excess of 0.045%, and thus excessive addition is not economical. Moreover, an excessive addition of Nb makes a stable production of steel difficult. Therefore, Nb must be added in the range of 0.005% to 0.045%.

Al: 0.10% or less

The addition of Al is indispensable because Al acts as a deoxidizer and serves to clean the steel, and to this end, Al is preferably added in an amount of 0.005% at least. If, however, Al is admixed in excess of 0.10%, the possibility of a surface defect being caused due to alumina cluster, etc., increases, and therefore, Al is added in an amount of 0.10% or less.

In addition to the aforementioned elements, this invention allows unavoidable impurities of N, O and S in amounts of 0.0050%, 0.0070% and 0.010%, respectively. Particularly, the stretch flanging properly can be remarkably increased by reducing the S content, and this effect is conspicuous in a T.S. range of as high as 45 kgf/mm$^2$. Accordingly, the reduction of S becomes more effective in improving mechanical properties with increase in tensile strength.

Now, the reason for defining the crystal structure will be described.

As mentioned above, the object of this invention is to improve the ductility, in particular, the stretch flanging property.

An extremely excellent stretch flanging property can be obtained by reducing the percentage of the second phase, e.g., pearlite, and thereby increasing the percentage of the recrystallized ferrite to 95% or more, and by making the structure uniformly fine with a mean grain diameter of 20 μm or less.

In this case, an increased percentage of the pearlite (particularly a coarse one) at which a flange crack may be caused is unfavorable, and non-uniformity and coarseness of the recrystallized ferrite structure similarly bring about a disadvantageous effect. Accordingly, the percentage of the recrystallized ferrite should be 95% or more and the mean grain diameter of the recrystallized ferrite should be 20 μm or less.

Next, the conditions for production will be described.

An ordinary process may be employed for the producing steps from steelmaking to hot rolling, without any particular restrictions. Typical hot rolling conditions comprise a heating temperature of 1280° to 1180° C., a hot rolling finishing temperature of 900° to 800° C., and a coiling temperature of 650° to 500° C.

As for the cold rolling, generally, the reduction rate in thickness should desirably be high in order to obtain a fine recrystallized structure after annealing. In view of this, the lower limit for the reduction rate in thickness is set to 50%. If, however, the reduction rate in thickness is higher than required, an increase in the thickness of a hot rolled mother sheet is caused although it poses no particular problem in the properties.

With regard to a continuous annealing line for cold rolled steel sheets and an in-line anneal type continuous hot dip galvanizing line, the heating rate for annealing should desirably be high to obtain fine recrystallized grains, and to obtain uniform and fine recrystallized grains, the rate should be higher than 5° C./sec, preferably 10° C./sec or higher. The upper limit for the heating rate is about 100° C./sec, from technical and economical viewpoints for the installation of heating equipment.

The annealing temperature is in the range of 720° to 780° C. If the temperature is lower than 720° C., the recrystallization does not satisfactorily progress and the elongation and the stretch flanging property are lowered, thus making it impossible to obtain satisfactory properties. On the other hand, if the annealing temperature is higher than 780° C., a softening disadvantageously occurs due to the grain growth. According to this invention, since Nb is added, an abnormal growth of recrystallized grains is suppressed by the carbonitride of Nb, and thus a uniform and fine recrystallized ferrite structure can be obtained over a relatively wide range of temperature.

The retention time for the annealing may substantially be zero, but more advantageously be 20 seconds or longer in view of the stability of properties. If the retention time is longer than 60 seconds, however, the properties may be deteriorated due to an abnormal growth of grains, and therefore, the retention time is set to 20 to 60 seconds.

As for the application of steel sheets according to this invention, since the yield stress of original sheets is the most important factor as the strength of articles after the forming, a yield ratio (Y.R.=YS/TS) of 70% or higher is sometimes required at the expense of formability. Therefore, to obtain such a high strength and a suitable yield ratio, a rapid cooling at 20° C./sec or more is preferably effected in a temperature range of 700° to 500° C., in the cooling step subsequent to the annealing.

For the production of hot dip galvanized steel sheets, no particular restriction is imposed on the hot dip galvanizing step subsequent to the annealing, and an ordinary hot dip galvanizing process may be effected. In this invention, whether or not a galvanneal process is carried out does not arise any problem. The galvanneal process causes a little change in properties, and substantially identical properties are obtained regardless of whether or not the galvanneal process is effected.

EXAMPLE 1

Steel slabs of various compositions as shown in TABLE 1 were produced in accordance with a conventional procedure.

TABLE 1

| Steel type | Chemical Composition (%) C | Si | Mn | Nb | Al | N | O | S | Remarks |
|---|---|---|---|---|---|---|---|---|---|
| A | 0.07 | 0.02 | 0.80 | 0.015 | 0.025 | 0.0020 | 0.0020 | 0.010 | Present |
| B | 0.12 | 0.02 | 0.55 | 0.010 | 0.055 | 0.0015 | 0.0025 | 0.008 | invention |
| C | 0.05 | 0.01 | 1.00 | 0.025 | 0.070 | 0.0035 | 0.0030 | 0.015 | |
| D | 0.02 | 0.02 | 0.80 | 0.010 | 0.035 | 0.0030 | 0.0020 | 0.012 | Comparative |
| E | 0.18 | 0.03 | 0.70 | 0.015 | 0.040 | 0.0025 | 0.0025 | 0.010 | example |
| F | 0.07 | 0.02 | 0.30 | 0.025 | 0.025 | 0.0030 | 0.0020 | 0.010 | |
| G | 0.07 | 0.02 | 1.50 | 0.030 | 0.025 | 0.0040 | 0.0020 | 0.010 | |
| H | 0.07 | 0.10 | 1.00 | 0.020 | 0.030 | 0.0035 | 0.0030 | 0.005 | |
| I | 0.07 | 0.02 | 0.80 | tr | 0.025 | 0.0020 | 0.0020 | 0.010 | |
| J | 0.03 | 0.02 | 1.00 | 0.015 | 0.025 | 0.0020 | 0.0020 | 0.007 | Present |
| K | 0.15 | 0.03 | 0.50 | 0.015 | 0.030 | 0.0020 | 0.0020 | 0.008 | invention |
| L | 0.07 | 0.05 | 0.80 | 0.015 | 0.025 | 0.0020 | 0.0030 | 0.010 | |
| M | 0.05 | 0.01 | 1.20 | 0.025 | 0.040 | 0.0020 | 0.0025 | 0.007 | |
| N | 0.07 | 0.01 | 1.20 | 0.005 | 0.040 | 0.0015 | 0.0020 | 0.005 | |
| O | 0.07 | 0.01 | 0.80 | 0.045 | 0.025 | 0.0020 | 0.0015 | 0.007 | |
| P | 0.05 | 0.01 | 0.80 | 0.025 | 0.100 | 0.0030 | 0.0025 | 0.015 | |

These steel slabs were subjected to hot rolling and cold rolling, under the conditions shown in TABLE 2, and then subjected to annealing in a continuous annealing line.

The steel sheets thus obtained were measured as to tensile properties, and side bend elongation property corresponding to stretch flanging property, the evaluation results being shown in TABLE 3. The tensile test was conducted by means of test pieces according to JIS 5. The side bend elongation property was evaluated in accordance with the method disclosed in Japanese Patent Publication No. 50-35438. Namely, rectangular test pieces of 40 mm wide and 170 mm long were prepared by shearing, such that a proper clearance is obtained, and the sheared faces were lightly finished with sandpaper before being subjected to test. The test pieces were subjected to in-plane deformation, and the elongation at the flange was measured immediately after the occurrence of a crack.

TABLE 2

| Slab Heating Temperature (°C.) | Rolling Finishing Temperature (°C.) | Coiling Temperature (°C.) | Reduction Rate (%) | Heating Rate °C./s | Annealing Temperature °C. | Annealing Time s | Cooling Rate °C./s |
|---|---|---|---|---|---|---|---|
| 1280 ∫ 1220 | 900 ∫ 780 | 600 ∫ 520 | 50 | 10 | 740 | 20 | 25 |

TABLE 3

| Steel type | Y.S. kgf/mm² | T.S. kgf/mm² | El. % | Y.R. % | Side Bend Elongation % | Percentage of Second Phase % | Mean Diameter of Ferrite Grains μm | Remarks |
|---|---|---|---|---|---|---|---|---|
| A | 40 | 46 | 37 | 87 | >60 | 3 | 14 | Present |
| B | 39 | 47 | 37 | 83 | >60 | 4 | 14 | invention |
| C | 40 | 48 | 35 | 83 | >60 | 2 | 12 | |
| D | 34 | 36 | 35 | 94 | 58 | <1 | 26 | Comparative |
| E | 36 | 49 | 32 | 73 | 45 | 8 | 13 | example |
| F | 42 | 43 | 25 | 98 | 45 | 3 | 25 | |
| G | 38 | 45 | 33 | 84 | 50 | 2 | 11 | |
| H | 39 | 43 | 30 | 91 | 48 | 2 | 12 | |
| I | 34 | 38 | 25 | 89 | 60 | 7 | 25 | |
| J | 39 | 47 | 37 | 83 | >60 | 2 | 13 | Present |
| K | 39 | 49 | 37 | 80 | >60 | 4 | 14 | invention |
| L | 39 | 48 | 37 | 81 | >60 | 3 | 14 | |

TABLE 3-continued

| Steel type | Y.S. kgf/mm² | T.S. kgf/mm² | El. % | Y.R. % | Side Bend Elongation % | Percentage of Second Phase % | Mean Diameter of Ferrite Grains μm | Remarks |
|---|---|---|---|---|---|---|---|---|
| M | 41 | 50 | 35 | 82 | >60 | 3 | 14 | |
| N | 41 | 47 | 37 | 87 | >60 | 3 | 14 | |
| O | 42 | 50 | 35 | 84 | >60 | 2 | 13 | |
| P | 42 | 49 | 35 | 86 | >60 | 2 | 12 | |

From TABLE 3, it will be understood that, as far as the contents of the elements fall within the respective ranges as defined in this invention, the steel sheets exhibit a high strength (T.S.≧40 kgf/mm²) and yet an excellent elongation (El.) and a side bend elongation (i.e., stretch flanging property). Moreover, a proper yield ratio is attained.

EXAMPLE 2

Using the steel A having the composition shown in TABLE 1, cold rolled steel sheets were produced under various conditions shown in TABLE 4, and the obtained sheets were examined in respect of tensile property and side bend elongation property, as in EXAMPLE 1.

TABLE 4

| No. | Reduction Rate (%) | Heating Rate (°C./s) | Annealing Temperature (°C.) | Annealing Time (s) | Cooling Rate (°C./s) | Remarks |
|---|---|---|---|---|---|---|
| 1 | 60 | 12 | 740 | 20 | 25 | Present |
| 2 | 70 | 10 | 730 | 40 | 27 | Invention |
| 3 | 45 | 10 | 740 | 20 | 30 | Comparative |
| 4 | 60 | 3 | 740 | 40 | 22 | Example |
| 5 | 60 | 20 | 760 | 20 | 32 | Present invention |
| 6 | 60 | 12 | 700 | 40 | 28 | Comparative |
| 7 | 60 | 12 | 800 | 40 | 30 | example |
| 8 | 55 | 15 | 725 | 5 | 25 | |
| 9 | 50 | 15 | 725 | 40 | 30 | Present |
| 10 | 60 | 5 | 740 | 30 | 30 | invention |
| 11 | 60 | 12 | 780 | 30 | 25 | |
| 12 | 55 | 10 | 720 | 40 | 25 | |
| 13 | 60 | 10 | 725 | 60 | 20 | |

TABLE 5

| No. | Y.S. kgf/mm² | T.S. kgf/mm² | Y.R. % | El. % | Side Bend Elongation % | Percentage of Second Phase % | Mean Diameter of Ferrite Grains μm |
|---|---|---|---|---|---|---|---|
| 1 | 39 | 47 | 83 | 38 | >60 | 1.8 | 19 |
| 2 | 38 | 46 | 83 | 39 | >60 | 1.7 | 17 |
| 3 | 66 | 71 | 93 | 9 | 20 | 2.1 | 24 |
| 4 | 38 | 40 | 95 | 38 | >60 | 3.2 | 23 |
| 5 | 39 | 47 | 83 | 36 | >60 | 2.1 | 19 |
| 6 | 55 | 65 | 85 | 12 | 28 | 1.8 | partially non-recrystallized |
| 7 | 33 | 35 | 94 | 35 | >60 | 3.1 | 22 |
| 8 | 49 | 56 | 87 | 19 | 30 | 3 | partially non-recrystallized |
| 9 | 37 | 46 | 80 | 38 | >60 | 2.2 | 17 |
| 10 | 40 | 48 | 83 | 38 | >60 | 1.7 | 17 |
| 11 | 37 | 46 | 80 | 38 | >60 | 1.5 | 17 |
| 12 | 40 | 49 | 81 | 37 | >60 | 2.2 | 17 |
| 13 | 39 | 46 | 85 | 38 | >60 | 1.5 | 17 |

As is clearly seen from TABLE 5, a satisfactory balance between strength and elongation and a satisfactory stretch flanging property can be obtained as far as the conditions for production according to this invention are fulfilled.

EXAMPLE 3

To examine the influence of the structure on the ductility and the stretch flanging property, specimens having the compositions shown in TABLE 6 were prepared under the conditions also shown in the same table, and the relationship between these properties was observed. The results are summarized in TABLE 7.

From TABLE 7 it follows that satisfactory properties can be obtained by properly controlling the percentage of the second phase, the mean diameter of recrystallized ferrite grains, and the area fraction of recrystallized ferrite. Among the Comparative Examples, Comparative Example E, has a T.S. lower than 40 kgf/mm² and is excellent in elongation and side bend elongation property, but the mean grain diameter of ferrite is greater than 20 μm, and therefore, its properties are not of satisfactory degree.

TABLE 6 (1)

| Steel type | Chemical Composition (%) C | Si | Mn | Nb | Al | N | O | S | Reduction Rate (%) |
|---|---|---|---|---|---|---|---|---|---|
| A' | 0.05 | 0.01 | 0.80 | 0.015 | 0.025 | 0.0020 | 0.0020 | 0.008 | 60 |
| B' | 0.07 | 0.01 | 0.80 | 0.015 | 0.015 | 0.0015 | 0.0020 | 0.005 | 70 |
| C' | 0.05 | 0.01 | 1.20 | 0.070 | 0.045 | 0.0020 | 0.0030 | 0.008 | 55 |
| D' | 0.18 | 0.01 | 0.90 | 0.015 | 0.035 | 0.0025 | 0.0030 | 0.010 | 55 |
| E' | 0.18 | 0.01 | 1.00 | 0.040 | 0.035 | 0.0025 | 0.0040 | 0.010 | 55 |

TABLE 6 (2)

| Steel type | Heating Rate (°C./s) | Annealing Temperature (°C.) | Annealing Time (s) | Cooling Rate (°C./s) | Remarks |
|---|---|---|---|---|---|
| A' | 5 | 760 | 30 | 25 | Present |
| B' | 10 | 780 | 40 | 27 | Invention |
| C' | 7 | 740 | 40 | 20 | Compar- |
| D' | 7 | 750 | 40 | 25 | ative |
| E' | 7 | 750 | 40 | 20 | Example |

EXAMPLE 4

Steel slabs having the various compositions as shown in TABLE 1 mentioned above were prepared by a conventional procedure. These steel slabs were subjected to hot rolling and cold rolling under the conditions illustrated in TABLE 8, and then subjected to annealing in an in-line anneal type continuous hot dip galvanizing line. After this, a hot dipping step and a galvannealing step were effected to produce hot dip galvannealed steel sheets.

The steels sheets thus prepared were measured as to the tensile property and the side bend elongation property corresponding to the stretch flanging property, the measurement results being shown in TABLE 9. The tensile test was conducted by means of test pieces according to JIS 5, and the side bend elongation property was evaluated in the same manner as in EXAMPLE 1.

TABLE 8

| Slab Heating Temperature (°C.) | Rolling Finishing Temperature (°C.) | Coiling Temperature (°C.) | Reduction Rate (%) | Heating Rate °C./s | Annealing Temperature °C. | Annealing Time s | Cooling Rate °C./s | Others |
|---|---|---|---|---|---|---|---|---|
| 1280 ∫ 1220 | 900 ∫ 780 | 600 ∫ 520 | 50 | 10 | 740 | 20 | 5 ∫ 20 | Galvannealing |

TABLE 9

| Steel type | Y.S. kgf/mm² | T.S. kgf/mm² | Y.R. % | El. % | Side Bend Elongation % | Others | Percentage of Second Phase % | Mean Diameter of Ferrite Grains μm | Remarks |
|---|---|---|---|---|---|---|---|---|---|
| A | 39 | 45 | 87 | 38 | >60 | | 3 | 15 | Present |
| B | 38 | 46 | 83 | 37 | >60 | | 4 | 17 | invention |
| C | 40 | 48 | 83 | 34 | >60 | | 2 | 15 | |
| D | 33 | 35 | 94 | 35 | 57 | | <1 | 28 | Comparative |
| E | 35 | 48 | 73 | 33 | 44 | | 9 | 13 | example |
| F | 41 | 42 | 98 | 25 | 44 | | 3 | 26 | |
| G | 38 | 45 | 84 | 34 | 51 | | 2 | 12 | |
| H | 39 | 43 | 91 | 29 | 49 | * | 3 | 12 | |
| I | 34 | 38 | 89 | 24 | 59 | | 7 | 25 | |
| J | 38 | 45 | 84 | 36 | >60 | | 5 | 12 | Present |
| K | 38 | 47 | 81 | 37 | >60 | | 4 | 15 | invention |
| L | 38 | 46 | 83 | 37 | >60 | | 4 | 15 | |
| M | 40 | 48 | 83 | 36 | >60 | | 4 | 13 | |
| N | 40 | 46 | 87 | 37 | >60 | | 2 | 14 | |
| O | 41 | 48 | 85 | 34 | >60 | | 3 | 12 | |
| P | 41 | 48 | 85 | 36 | >60 | | 3 | 13 | |

*Incomplete hot dipping frequently occurred.

TABLE 7

| Steel type | Percentage of Second Phase (%) | Mean Diameter of Ferrite Grains (μm) | Area Yield of Recrystallized Ferrite (%) | El. % | Side Bend Elongation (%) |
|---|---|---|---|---|---|
| A' | Pearlite <2% | 14 | 98 | 38 | >60 |
| B' | Same as Above | 17 | ~100 | 38 | >60 |
| C' | Same as Above | 18 | 90 | 30 | 31 |
| D' | Pearlite 7% | 14 | 93 | 32 | 36 |
| E' | Pearlite 6% | 23 | 94 | 33 | >60 |

From TABLE 9 it follows that, as far as the contents of the elements are within the respective ranges as defined in this invention, high strength (T.S.≧40 kgf/mm²) is achieved while at the same time a satisfactory elongation (El.) and a satisfactory side bend elongation, i.e., stretch flanging property, are obtained.

EXAMPLE 5

Using the steel A having the composition shown in TABLE 1, hot dip galvanized steel sheets and galvannealed steel sheets were prepared under the various conditions shown in TABLE 10, and these sheets were examined as to the tensile property and the side bend elongation property, as in EXAMPLE 1, the results being summarized in TABLE 11.

TABLE 10

| No. | Reduction Rate (%) | Heating Rate (°C./s) | Annealing Temperature (°C.) | Annealing Time (s) | Cooling Rate (°C./s) | Galvannealing (Yes, No) | Remarks |
|---|---|---|---|---|---|---|---|
| 1 | 60 | 12 | 740 | 20 | 30 | Yes/no | Present |
| 2 | 70 | 10 | 730 | 40 | 30 | Yes | Invention |
| 3 | 45 | 10 | 740 | 20 | 35 | Yes | Comparative |
| 4 | 60 | 3 | 740 | 40 | 20 | Yes | Example |
| 5 | 60 | 20 | 760 | 20 | 30 | Yes/no | Present invention |
| 6 | 60 | 12 | 700 | 40 | 29 | Yes | Comparative |
| 7 | 60 | 12 | 800 | 40 | 30 | Yes | example |
| 8 | 55 | 15 | 725 | 5 | 27 | Yes | |
| 9 | 50 | 15 | 725 | 40 | 30 | Yes | Present |
| 10 | 60 | 5 | 740 | 30 | 30 | Yes | invention |
| 11 | 60 | 12 | 780 | 30 | 25 | Yes | |
| 12 | 55 | 10 | 720 | 40 | 20 | Yes | |
| 13 | 60 | 10 | 725 | 60 | 25 | Yes | |

TABLE 11

| No. | Y.S. kgf/mm² | T.S. kgf/mm² | Y.R. % | El. % | Side Bend Elongation % | Percentage of Second Phase % | Mean Diameter of Ferrite Grains μm |
|---|---|---|---|---|---|---|---|
| 1 | 38 | 46 | 83 | 39 | >60 | 1.5 | 18 |
| 2 | 38 | 46 | 83 | 38 | >60 | 1.5 | 17 |
| 3 | 65 | 70 | 93 | 8 | 20 | 2 | 25 |
| 4 | 38 | 40 | 95 | 39 | >60 | 3 | 23 |
| 5 | 39 | 47 | 83 | 37 | >60 | 2 | 18 |
| 6 | 55 | 65 | 85 | 12 | 28 | 1.5 | partially non-recrystallized |
| 7 | 33 | 35 | 94 | 36 | >60 | 3 | 22 |
| 8 | 48 | 55 | 87 | 18 | 30 | 3 | partially non-recrystallized |
| 9 | 37 | 46 | 80 | 37 | >60 | 2.0 | 18 |
| 10 | 38 | 46 | 83 | 38 | >60 | 1.5 | 17 |
| 11 | 37 | 46 | 80 | 39 | >60 | 1.5 | 18 |
| 12 | 38 | 47 | 81 | 38 | >60 | 2.0 | 17 |
| 13 | 39 | 46 | 85 | 38 | >60 | 1.5 | 17 |

As is seen from TABLE 11, as far as the producing conditions as defined in this invention are fulfilled, a satisfactory balance between strength and elongation and a satisfactory stretch flanging property can be achieved. Whether or not the galvanneal step is effected has a little influence on the properties, and substantially identical properties were obtained.

EXAMPLE 6

To examine the influence of the structure on the ductility and the stretch flanging property, specimens having the compositions shown in TABLE 12 were prepared under the conditions also shown in the same table, and the relationship between these properties was observed. The results are summarized in TABLE 13.

From TABLE 13 it follows that satisfactory properties can be obtained by properly controlling the percentage of the second phase, the mean diameter of recrystallized ferrite grains, and the area fraction of recrystallized ferrite. Among the Comparative Examples, Comparative Example E' has a T.S. lower than 40 kgf/mm² and is excellent in elongation and side bend elongation property, but the mean grain diameter of ferrite is greater than 20 μm, and therefore, its properties are not of satisfactory degree.

TABLE 12 (1)

| Steel type | Chemical Composition (%) C | Si | Mn | Nb | Al | N | O | S | Reduction Rate (%) | Heating Rate (°C./s) |
|---|---|---|---|---|---|---|---|---|---|---|
| A' | 0.05 | 0.01 | 0.80 | 0.015 | 0.025 | 0.0020 | 0.0020 | 0.008 | 60 | 5 |
| B' | 0.07 | 0.01 | 0.80 | 0.015 | 0.015 | 0.0015 | 0.0020 | 0.005 | 70 | 10 |
| C' | 0.05 | 0.01 | 1.20 | 0.070 | 0.045 | 0.0020 | 0.0030 | 0.008 | 55 | 7 |
| D' | 0.18 | 0.01 | 0.90 | 0.015 | 0.035 | 0.0025 | 0.0030 | 0.010 | 55 | 7 |
| E' | 0.18 | 0.01 | 1.00 | 0.040 | 0.035 | 0.0025 | 0.0040 | 0.010 | 55 | 7 |

TABLE 12 (2)

| Steel type | Annealing Temperature (°C.) | Annealing Time (s) | Cooling Rate (°C./s) | Galvannealing (Yes, No) | Remarks |
|---|---|---|---|---|---|
| A' | 760 | 30 | 23 | Yes | Present |
| B' | 780 | 40 | 25 | Yes | Invention |
| C' | 740 | 40 | 23 | Yes | Comparative |
| D' | 750 | 40 | 20 | Yes | Example |
| E' | 750 | 40 | 25 | Yes | |

TABLE 13

| Steel type | Percentage of Second Phase (%) | Mean Diameter of Ferrite Grains (μm) | Area Yield of Recrystallized Ferrite (%) | El. % | Side Bend Elongation (%) |
|---|---|---|---|---|---|
| A' | Pearlite <2% | 15 | 98 | 39 | >60 |
| B' | Same as Above | 18 | ~100 | 37 | >60 |
| C' | Same as Above | 18 | 90 | 31 | 30 |
| D' | Pearlite 8% | 15 | 92 | 31 | 35 |
| E' | Pearlite 7% | 25 | 93 | 34 | >60 |

EXAMPLE 7

Using steels having compositions shown in TABLE 14, hot rolling was effected at a hot rolling finishing temperature of 800° to 850° , and cold rolling was effected at a reduction rate in thickness of 65%. Thereafter, the sheets were subjected to annealing at a heating rate of 10° C./sec and then uniformly heated at 740° C. for 30 seconds. After a hot dipping step and a galvannealing step were effected, the stretch flanging property was measured in accordance with the same procedure as in EXAMPLE 1.

TABLE 14

| Steel | Chemical Composition (%) | | | | | | | |
|---|---|---|---|---|---|---|---|---|
| type | C | Si | Mn | Nb | Al | N | O | S |
| Q | 0.07 | 0.02 | 0.85 | 0.010 | 0.025 | 0.020 | 0.010 | 0.010 |
| R | 0.08 | 0.02 | 0.80 | 0.012 | 0.035 | 0.025 | 0.015 | 0.007 |
| S | 0.07 | 0.01 | 0.75 | 0.010 | 0.020 | 0.025 | 0.010 | 0.005 |
| T | 0.07 | 0.02 | 0.75 | 0.012 | 0.025 | 0.025 | 0.010 | 0.003 |
| U | 0.08 | 0.01 | 0.85 | 0.012 | 0.025 | 0.025 | 0.010 | 0.001 |

When carrying out the test, the shearing was effected such that the clearance is greater than an ordinary one, and the end faces were not finished at all, to conduct the test under stricter conditions than those in EXAMPLE 1. The results of the test are shown in TABLE 15.

TABLE 15

| Steel type | Side Bend Elongation (%) |
|---|---|
| Q | 55% |
| R | 57% |
| S | >60% |
| T | >60% |
| U | >60% |

From TABLE 15 it follows that although steel Q has a satisfactory side bend elongation of 55%, compared with a conventional material, this property can be further improved by reducing the S content. In TABLE 15, >60% represents the state in which the test piece was slipped off from the jig and no crack was produced, and thus an extremely excellent side bend elongation property (stretch flanging property).

This invention provides a high tensile cold rolled steel sheet and a hot dip galvanized sheet which, unlike conventional counterparts, have high strength and yet are excellent in ductility and stretch flanging property. Conventional high tensile steel sheets having a T.S. of 40 kgf/mm$^2$ or higher have problems in that cracks are produced during press working chiefly due to deficiency in stretch flanging property and that they do not have a yield ratio high enough to retain a sufficient strength after being subjected to a forming process to produce, e.g., parts of automobiles. In the case of hot dip galvanized steel sheets, the surface treatment can often hinder the improvement in strength and hot dipping property. These problems are solved by this invention which provides a fine and uniform ferrite phase. The steel sheets of this invention can be used especially for rust-proof reinforcing members in automobiles.

What is claimed is:

1. A high tensile cold rolled steel sheet improved in stretch flanging property, consisting essentially of 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities, and the steel sheet having a uniform and fine recrystallized ferrite structure having a mean grain diameter of 20 μm or less and an area fraction of 95% or more.

2. A process for producing a high tensile cold rolled steel sheet improved in stretch flanging property, comprising the steps of:

preparing, as a material, steel consisting essentially of 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities;

subjecting the material to hot rolling;

effecting cold rolling at a reduction rate in thickness of more than 50%; and effecting annealing in which the material is heated at a heating rate of 5° C./sec or more and retained in a temperature range of 720° to 780° C. for 20 to 60 seconds in a continuous annealing line, and then cooling the material.

3. A high tensile hot dip galvanized steel sheet improved in stretch flanging property, consisting essentially of 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities, and the steel sheet having a uniform and fine recrystallized ferrite structure having a mean grain diameter of 20 μm or less and an area fraction of 95% or more.

4. A process for producing a high tensile hot dip galvanized steel sheet improved in stretch flanging property, comprising the steps of:

preparing, as a material, steel consisting essentially of 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities;

subjecting the material to hot rolling;

effecting cold rolling at a reduction rate in thickness of more than 50%; and effecting annealing in which the material is heated at a heating rate of 5° C./sec or more and retained in a temperature range of 720° to 780° C. for 20 to 60 seconds in an in-line anneal type continuous hot dip galvanizing line, and then cooling and hot-dipping the material.

5. A process for producing a high tensile hot dip galvanized steel sheet improved in stretch flanging property, comprising the steps of:

preparing, as a material, steel consisting essentially of 0.03% to 0.15% by weight of C, 0.05% or less by weight of Si, 0.5% to 1.2% by weight of Mn, 0.005% to 0.045% by weight of Nb, and 0.10% or less by weight of Al, the remainder being iron and unavoidable impurities;

subjecting the material to hot rolling;

effecting cold rolling at a reduction rate in thickness of more than 50%; and effecting annealing in which the material is heated at a heating rate of 5° C./sec or more and retained in a temperature range of 720° to 780° C. for 20 to 60 seconds in an in-line anneal type continuous hot dip galvanizing line, and then cooling, hot-dipping and galvannealing the material.

* * * * *